US009109414B2

(12) United States Patent
Lapeyrouse et al.

(10) Patent No.: US 9,109,414 B2
(45) Date of Patent: Aug. 18, 2015

(54) SOLIDS WASTE, SOLIDIFICATION MATERIAL MIXING AND CONVEYANCE UNIT

(75) Inventors: Todd M. Lapeyrouse, Pittsburgh, PA (US); Richard T. Collins, Morgantown, WV (US)

(73) Assignee: BAKER HUGHES INCORPORATED, Houston, TX (US)

( * ) Notice: Subject to any disclaimer, the term of this patent is extended or adjusted under 35 U.S.C. 154(b) by 330 days.

(21) Appl. No.: 13/468,966

(22) Filed: May 10, 2012

(65) Prior Publication Data

US 2013/0299166 A1 Nov. 14, 2013

(51) Int. Cl.
*E21B 21/01* (2006.01)
*E21B 21/06* (2006.01)
*E21B 27/04* (2006.01)

(52) U.S. Cl.
CPC ..... *E21B 21/066* (2013.01); *E21B 27/04* (2013.01)

(58) Field of Classification Search
CPC ..... E21B 21/01; E21B 21/066; E21B 21/068; E21B 27/04; B01D 2221/04
USPC ..... 166/267, 75.12; 175/207, 206, 226, 88
See application file for complete search history.

(56) References Cited

U.S. PATENT DOCUMENTS

| | | | | |
|---|---|---|---|---|
| 5,028,010 | A * | 7/1991 | Sansing | 241/101.8 |
| 5,344,570 | A * | 9/1994 | McLachlan et al. | 210/709 |
| 5,419,839 | A * | 5/1995 | Haley et al. | 405/129.2 |
| 5,494,584 | A * | 2/1996 | McLachlan et al. | 210/739 |
| 5,570,749 | A * | 11/1996 | Reed | 175/66 |
| 5,609,836 | A * | 3/1997 | McManus et al. | 422/233 |
| 5,814,230 | A * | 9/1998 | Willis et al. | 210/710 |
| 6,585,115 | B1 * | 7/2003 | Reddoch et al. | 209/3 |
| 6,711,830 | B2 * | 3/2004 | Hensley et al. | 34/357 |
| 7,404,903 | B2 * | 7/2008 | Bozak et al. | 210/708 |
| 7,901,571 | B2 * | 3/2011 | Woods et al. | 210/96.1 |
| 2004/0042335 | A1 * | 3/2004 | Cecala et al. | 366/151.1 |
| 2013/0299166 | A1 * | 11/2013 | Lapeyrouse et al. | 166/267 |

* cited by examiner

*Primary Examiner* — Jennifer H Gay
(74) *Attorney, Agent, or Firm* — Mossman Kumar & Tyler PC

(57) ABSTRACT

A system for processing solids may include a solids mover configured to receive the solids from the separator and convey the solids to at least one disposal container and a solidification material applicator configured to apply a solidification material to the solids in the solids mover. A related method includes conveying the solids from the separator to at least one disposal container using a solids mover and applying the solidification material to the solids in the solids mover using a solidification material applicator.

9 Claims, 2 Drawing Sheets

SOLIDS WASTE, SOLIDIFICATION MATERIAL MIXING AND CONVEYANCE UNIT

FIELD OF THE DISCLOSURE

1. Field of the Disclosure

This disclosure relates generally to handling of waste materials especially particulate drill solids.

2. Background of the Disclosure

Hydrocarbons such as oil and gas are recovered from a subterranean formation using a wellbore drilled into the formation. When an oil well is drilled, a drilling fluid, commonly referred to as drilling mud, is used to lubricate and cool the drill bit and to carry away cuttings of rock and earth. Conventionally, the drilling mud is circulated through the well using a mud supply, which may include one or more mud pumps and a mud tank. The drilling mud pumped into the well is relatively debris-free. However, the drilling mud returning from the well will include solids such as cuttings. The returning drilling mud is usually filtered to remove the solids and returned to the mud supply. The solids separated from the returning fluids must usually be treated in some manner prior to disposal. The type of treatment may depend on the regulatory guidelines for a particular well. In some instances, the "wetness" of the solids may have to be reduced to cost-efficiently dispose of these solids.

The present disclosure addresses the need to treat wet solids prior to disposal.

SUMMARY OF THE DISCLOSURE

In one aspect, the present disclosure provides a system for processing solids. The system may include a drill rig configured to form a wellbore in an earthen formation, the drill rig including a separator configured to generate a flow of solids from a discharge; an intake auger positioned under the separator discharge and configured to receive the cuttings; a discharge auger configured to receive cuttings from the intake auger; and a solidification material applicator. The solidification material applicator may include an injector configured to apply a solidification material to the solids in the discharge auger; a surge can configured to dispense the solidification material to the injector; a bulk silo configured to supply the solidification material to the surge can; and a conduit for conveying the solidification material from the bulk silo to the surge can.

In another aspect, the system may include a solids mover configured to receive the solids from the separator and convey the solids to at least one disposal container; and a solidification material applicator configured to apply a solidification material to the solids in the solids mover.

In yet another aspect, the present disclosure provides a method for processing solids generated by a separator used during drilling operations. The method may include conveying the solids from the separator to at least one disposal container using a solids mover; and applying the solidification material to the solids in the solids mover using a solidification material applicator.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing.

DETAILED DESCRIPTION

In aspects, the present disclosure uses a solidification material to reduce a wetness of solids that must be disposed of while drilling a well. As used herein, the term "wetness" generally refers to the amount of liquids in the solids. With respect to hydrocarbon liquids such as oil, the term residual oil content ("ROC") is sometimes used to describe this condition. However, the residual liquid may be oil, water, naturally occurring, or human-made. In some instances, "wetness" may be evaluated with reference to the mobility of the residual liquids and the ability of these liquids to leach out of the solids. Merely for brevity, the teachings of the present disclosure are discussed with reference to the FIGS. 1-3, which show an illustrative land-based drill rig. However, the present teachings disclosure may be readily adapted to meet the operational and physical requirements of any well drilling facility, whether land or offshore.

Figure 1:
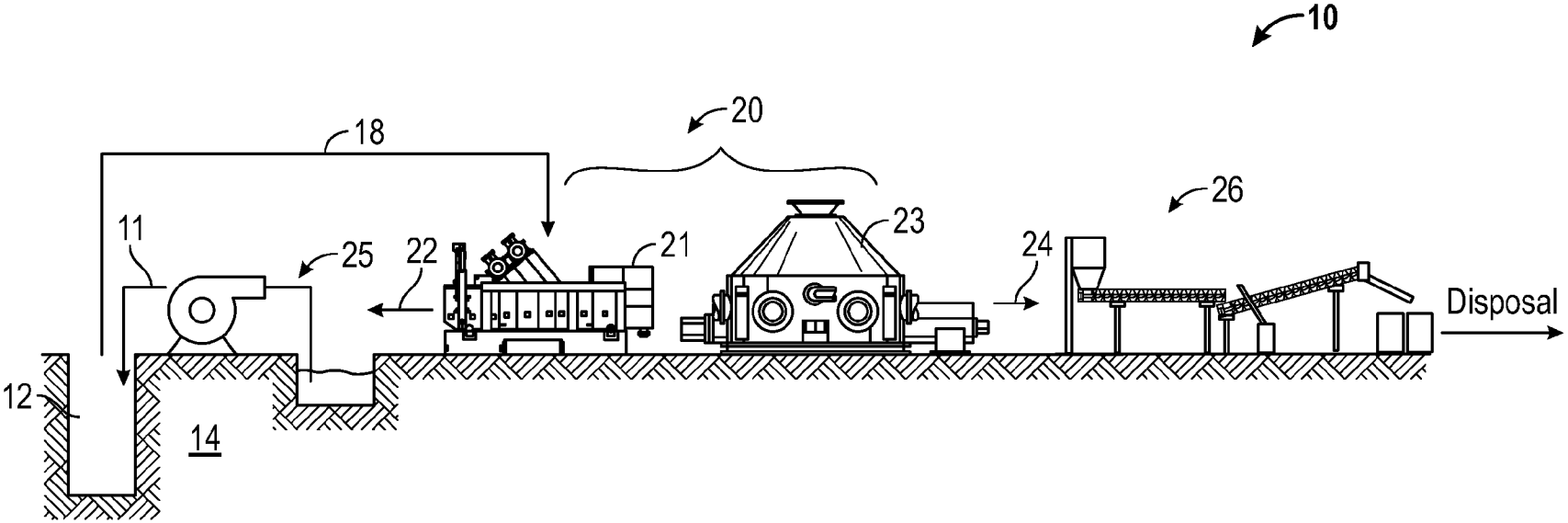
FIG. 1 schematically illustrates a drill rig that processes solids in accordance with one embodiment of the present disclosure.

Referring to FIG. 1, there is shown a system 10 for drilling a wellbore 12 into an earthen formation 14. During drilling, a drill string (not shown) forms the borehole 12 while a drilling fluid 11 is circulated in the wellbore. The drilling fluid, or drilling "mud," may be a water-based, oil-based, or a synthetic-based drilling fluid. This fluid returns with entrained solids, or a return fluid 18, and is directed into a separator 20. The separator 20 outputs a liquids stream consisting of drilling mud 22 and a slurry of solids 24. The drilling mud 22 may be conveyed to a mud supply 25 for re-use in the wellbore 12. The mud supply 25 may include known devices such as mud pumps and mud pits. The solids 24 may be conveyed to a solids processing system 26. The solids processing system 26 mixes a solidification material with the solids and directs the solidified cuttings into one or more disposal containers. The solids 24 may include granular bits of rock, earth, debris, and other like material.

The separator 20 may include one or more devices for extracting the drilling fluid from the return fluid 18 and generating a solids slurry. In one arrangement, the separator 20 can include one or more shale shakers. Within the shale shaker, the return fluid and entrained solids are discharged over a vibratory separator 21 that has one or a series of tiered screens. The screens catch and remove solids from the return fluid flowing therethrough. The separator 20 can also include other separation devices such as centrifugal separator 23. Still other separation devices include mud cleaners, cuttings dryers, and cyclone separators. As used herein the term "separator" is used to denote one or more such devices that separately or cooperatively separate liquids from solids. Such separation devices and techniques are known in the art and will not be discussed in further detail. As noted previously, the solids 24 outputted by the separations may be "wet," i.e., have residual liquid.

Figure 2:
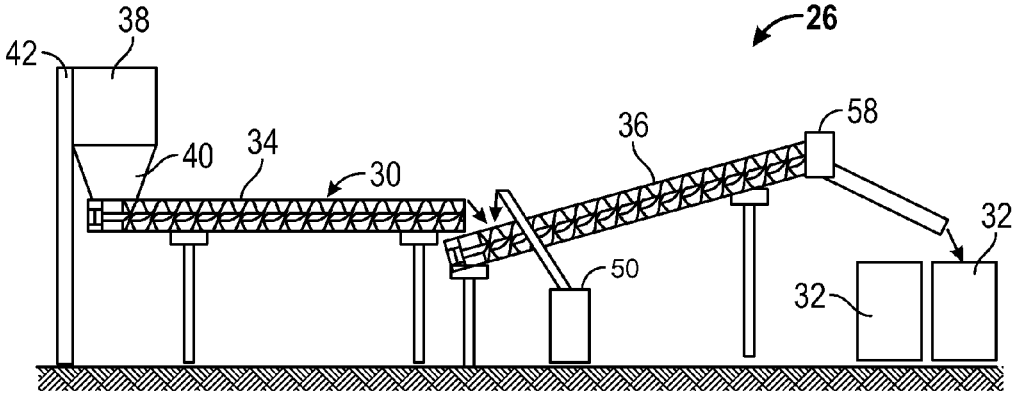
FIG. 2 schematically illustrates one embodiment of a solids processing system in accordance with the present disclosure.

Referring now to FIG. 2, there is shown one embodiment of a solids processing system 26 that uses a solidification material to treat wet solids 24. As used herein, the term solidification material is a material that reduces wetness of the solids. The wetness of the solids may be reduced by mechanically and/or chemically encapsulating residual liquid. In some instances, the liquid may be microencapsulated. For example, materials such as sawdust, cellulose fibers, and nut plugs may absorb liquid by drawing the liquid into void spaces (i.e., mechanical interaction). Materials such as kiln dust, lime, and calcium oxide react with liquid and chemically encapsulate the liquid. One non-limiting example of a solidification material is DRY-FIX available from BAKER HUGHES INCORPORATED. These materials chemically and/or mechanically immobilize the residual liquids and thereby reduce the wetness of the solids. Still other non-limiting types of solidification material include, but are not limited to, Portland cement, blast-furnace slag, microsilica, magnesium oxide cement, kalonite, gypsum, bentonite, clinker, and pulverized fuel ash. As used herein, the term "solidification material" refers to a material that is formulated to reduce wetness by encapsulating liquids mechanically (e.g., absorption) and/or chemically. The solidification material may include one or more components that reduce wetness by the same or different interactions.

In one embodiment, the system 26 may include a solids mover 30 that receives solids from the separator 20 (FIG. 1) and transports the solids to one or more container 32, which may be bulk tanks or vessel storage tanks. In one embodiment, the solids mover 26 may include an intake auger 34 and a discharge auger 36. The augers 34, 36 may be of a conventional design wherein a motor rotates a shaft having one or more helical blades. The motor may be a fixed speed or variable speed motor energized by known means (e.g., electrical, hydraulic, pneumatic, etc.). Shaft rotation forces the material in the blades to move from one end of the auger to the other. It should be understood that an auger is a non-limiting example of a device suitable for conveying the solids. Other mechanisms may also be used for the solids mover (e.g., conveyor belt, pressurized air, etc.)

In one arrangement, the intake auger 34 is oriented horizontally and installed directly underneath a discharge of the separator system 20 (FIG. 1). For example, installing the intake auger 34 beneath a centrifuge discharge 38 enables the solids to dump into the intake auger 34 through a hopper 40 installed on the bottom of the centrifuge stand 42. The intake auger 34 may include splash guards (not shown) that also function as a solids diverter in the event of an auger failure. For instance, the splash guards may be hinged or otherwise adjustably mounted. If needed, the splash guards may be folded or configured to function as chutes or slides that bypass the intake auger 34 and divert solids into an open top of the container 32.

The discharge auger 36 is configured to receive solids from the intake auger 34 and mix the solids with the solidification material received from a solidification materials applicator 50. The discharge auger 36 directs the solids to receptacles such as the containers 32. In some arrangements, the discharge auger 36 may be inclined such that the terminal end 58 of the discharge auger 36 is elevated, which facilitates dumping the solids into the open top end of the containers 32. Additionally, the terminal end 58 may include an articulated joint, swivel, hinge or other similar mechanism that allows the terminal end 58 to be shifted or moved between two or more positions (e.g., side to side, up-down, etc.).

In some arrangements, the solidification material is introduced into the cuttings in the discharge auger 36. In such arrangements, the discharge auger 36 may be constructed and operated to agitate the solids to mix the solidification material with the solids. While the mixture need not be homogeneous, the solidification material should be evenly dispersed throughout the solids before the solids exit the discharge auger 36. Additionally, the location along the discharge auger 36 at which the solidification material is applied may be selected with reference to the time needed for the agitation to adequately mix the solids and the solidification material. The solids will become more viscous and more resemble a monolithic solid as the solidification material reacts with the solids. As the viscosity increases, the loading on the motor (not shown) of the discharge auger 36 also increases. Thus, it may be desirable to optimize operations by adding the solidification material at a point along the discharge auger 36 that allows sufficient time for adequate mixing but not so long as to force the auger motors to move solidified solids over an unnecessarily long distance.

Figure 3:
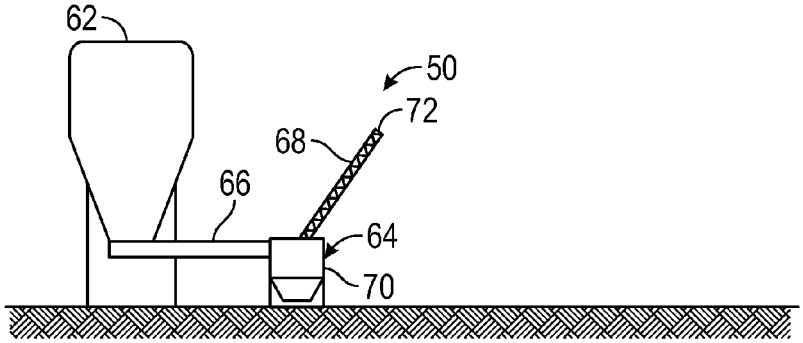
FIG. 3 schematically illustrates a system for applying solidification material in accordance with one embodiment of the present disclosure.

The solidification material applicator 50 adds the solidification material to the solids at one or more selected introduction points along the solids mover 30; e.g., into the discharge auger 36. Referring now to FIG. 3, there is shown one embodiment of a solidification material applicator 50 for applying a solidification material to the solids. In one arrangement, the solidification material applicator 50 may include a bulk silo 62 and a surge can 64. The bulk silo 62 may be an enclosure or container that is configured to store the solidification material in an enclosed space that is shielded from the environment. The enclosed and isolated interior of the bulk silo 62 reduces the risk that the solidification material may be degraded due to interaction with ambient moisture (e.g., rain) or be blown away due to winds. The bulk silo 62 may be configured to periodically flow solidification material into the surge can 64 via a suitable conduit 66. For example, a pneumatic blower (not shown) may blow a specified volume or quantity of solidification material into the surge can 64. This may be referred to as "charging" the surge can 64 with solidification material. It should be appreciated that the solidification material applicator 50 maintains the solidification material in a mostly enclosed environment (i.e., shielded from direct contact with moisture and winds) until the applied to the solids.

The surge can 64 may include an injector 68 that is fed by a hopper 70. The surge can 64 and the hopper 70 are containers or enclosures that cooperate to store a "charge" of solidification material. The injector 68 may be any known mover for conveying solidification material, which is usually granular in nature, such as a conveyor or pneumatic blower. As shown in this embodiment, the injector 68 may be a tubular auger that is inclined to allow a terminal end 72 to add the solidification material into the solids in the discharge auger 36 (FIG. 2). In one embodiment, the injector 68 may be configured to vary the amount of solidification material that is applied to the solids. For example, the injector 68 may be a variable speed auger that includes a controller (not shown) for increasing or decreasing the speed of the injector 68. The ability to vary the speed of the injector auger allows for control of the amount of solidification material used in accordance with real time needs, which effectively lowers total usage of solidification material.

Referring now to FIGS. 1-3, in one illustrative mode of use, the separator 20 continuously dumps solids 24 into the intake auger 34. The intake auger 34 conveys the solids from the separator 20 and ejects the solids into the discharge auger 36. As the solids are being conveyed along the discharge auger 36, the solidification material applicator 50 introduces the solidification material into the discharge auger 36. The discharge auger 36 mixes the solidification material with the solids. This mixing may cause exothermic reactions that heat and dry the solids and may also cause chemical and/or mechanical interactions that encapsulate residual liquids. The discharge auger 36 expels the solids mixture into the container 32. When one container 32 is full, the terminal end 58 of the discharge auger 36 may be shifted to fill another container 32. Periodically, the surge can 64 is charged with solidification material from the bulk silo 62 in order to maintain continuous operation.

For land rigs, the full containers 32 may be transported via land vehicles (e.g., trucks) to a suitable disposal site. At the disposal site, the solids may be tested for amount of "wetness." For instance, a quantity of solids may be compressed to determine how much liquid is released. The type of disposal selected may depend on the wetness of the solids. For offshore rigs, the full containers 32 may be transported via marine vehicles (e.g., barges) to a suitable disposal site for disposal in a similar manner. It should be appreciated that the desired or predetermined wetness for the solids, which may be used to control the amount of solidification material applied, may be set with reference to the wetness criteria used at disposal sites.

In one control method, a human operator may observe the condition of the solids mixture and vary the operation of the injector 68 as needed to meet a preset condition (e.g., a target solids wetness). If the solids mixture is estimated to be too wet, the operator may increase the speed of the injector 68 to increase the amount of solidification material being added to the solids. If the solids mixture is estimated to have excess solidification material, the operator may decrease the speed of the injector 68 to decrease the amount of solidification material being added to the solids. In some arrangements, the estimation may be done visually and the operator may control the speed of the auger 68 using local controls. In other embodiments, a liquid content sensor may be used to estimate the wetness of the solids and a controller may alter the operation of the injector 68 according to preprogrammed instructions.

It should be understood that the rig sites can vary in size, space, and complexity. Nevertheless, it should be appreciated that the system 10 may be configured and installed in a manner that accommodates the needs of specific location. For example, the solidification material may be added to the intake auger 34 instead of or in addition to the discharge auger 34. Moreover, the solids mover 30 may consist of one auger (or other comparable device) or three or more augers. Also, a high speed centrifuge can be rigged at either end of the intake auger 34 depending on layout of the site as well as accessibility to the back side of the mud pits (not shown) of the mud supply 25. Moreover, the amount of solidification material added may be controlled by various techniques, such as controlling the amount of solidification material in the surge can 64, in addition to controlling the speed of the injector 68. Therefore, sizes, discharge ports, and introduction points may be modified to adapt to specific needs on location.

While the foregoing disclosure is directed to the preferred embodiments of the invention, various modifications will be apparent to those skilled in the art. It is intended that all variations within the scope of the appended claims be embraced by the foregoing disclosure.

What is claimed:

1. A system for processing solids, comprising:

a drill rig configured to form a wellbore in an earthen formation, the drill rig including a separator configured to generate a flow of solids from a discharge;

an intake auger positioned under the separator discharge and configured to receive the cuttings;

an at least partially inclined discharge auger configured to receive cuttings from the intake auger, the discharge auger having an elevated terminal end, and a joint allowing movement of the terminal end between at least two positions;

a disposal container receiving the cuttings from the discharge auger, the terminal end of the discharge auger dumping the cuttings into an open end of the disposal container; and a solidification material applicator including:

an injector configured to apply a solidification material to the solids in the discharge auger, the injector having a terminal end and an opposite end;

a surge can configured to dispense the solidification material into the opposite end of the injector, the terminal end of the injector being external to the surge can;

a bulk silo configured to supply the solidification material to the surge can; and a conduit for conveying the solidification material from the bulk silo to the surge can.

2. The system of claim 1, wherein the solidification material is formulated to interact with the solids by at least one of: (i) chemically, and (ii) mechanically.

3. The system of claim 1, wherein the solidification material includes at least one of: (i) sawdust, (ii) cellulose fibers, (iii) nut plugs, (iv) kiln dust, (v) lime, and (vi) calcium oxide.

4. The system of claim 1, wherein the injector is an auger configured to vary the amount of solidification material applied into the discharge auger to obtain a desired wetness of the solids.

5. The system of claim 1, wherein the solidification material is formulated to reduce wetness by encapsulating liquids by a process selected from one of: (i) mechanically, and (ii) chemically.

6. The system of claim 1, wherein the bulk silo has a moisture controlled interior for storing the solidification material.

7. A method for processing solids generated by a separator used during drilling operations, comprising:

conveying the solids from the separator to at least one disposal container using a solids mover;

supplying a bulk silo with a solidification material;

charging a surge can with the solidification material from the bulk silo;

supplying the solidification material to a first end of an injector; and applying the solidification material to the solids in the solids mover from a second end of the injector, the second end of the injector being external to the surge can, the bulk silo, surge can and injector forming a solidification material applicator, the solidification material being applied while the solids mover dumps solids into the at least one disposal container;

visually estimating a wetness of the solids in the injector;

changing a speed of injector based on the visual inspection, wherein the speed of the injector is changed using a local control, and wherein the change is one of: (i) increasing the speed of the injector if the solids are estimated as too wet, and (ii) decreasing the speed of the injector if the solids are estimated as not wet enough.

8. The method of claim 7, wherein the solidification material is formulated to interact with the solids by at least one of: (i) chemically, and (ii) mechanically.

9. The method of claim 7, further comprising maintaining the solidification material in an enclosed environment until applied to the solids.

* * * * *